United States Patent [19]

Servi et al.

[11] Patent Number: 4,708,333

[45] Date of Patent: Nov. 24, 1987

[54] METHOD AND APPARATUS FOR SEPARATING, FEEDING AND/OR FOLDING SHEETS

[75] Inventors: Rami Servi; Boaz Eidelberg; Daniel Granot, all of Haifa; Ehud Armoza; Ephraim Sher, both of Carmiel, all of Israel

[73] Assignee: State of Israel, Ministry of Defense, Rafael Armament Development Authority, Haifa, Israel

[21] Appl. No.: 802,170

[22] Filed: Nov. 25, 1985

[30] Foreign Application Priority Data

Nov. 23, 1984 [IL] Israel ..... 73600
Jan. 4, 1985 [IL] Israel ..... 74001

[51] Int. Cl.[4] ..... B42C 1/00; B65H 3/40

[52] U.S. Cl. ..... 270/45; 270/58; 271/91; 271/93; 271/98; 271/106

[58] Field of Search ..... 270/45, 58; 271/97-98, 271/104, 106, 91-93

[56] References Cited

U.S. PATENT DOCUMENTS

| | | | |
|---|---|---|---|
| 1,460,314 | 6/1923 | Deck | 271/98 |
| 2,236,363 | 3/1941 | Backhouse | 271/98 |
| 3,168,308 | 2/1965 | Walton et al. | 271/106 X |
| 3,684,276 | 8/1972 | Bridgeman | 271/106 X |
| 3,980,293 | 9/1976 | Shelmire | 271/106 X |
| 4,231,568 | 11/1980 | Boucraut | 271/98 |
| 4,310,151 | 1/1982 | Fu Zimoto | 271/106 |
| 4,397,457 | 8/1983 | Hinchcliffe et al. | 271/98 |
| 4,568,073 | 2/1986 | Van Horne | 271/98 |
| 4,635,917 | 1/1987 | Granot et al. | 271/104 |

FOREIGN PATENT DOCUMENTS

| | | | |
|---|---|---|---|
| 1230812 | 12/1966 | Fed. Rep. of Germany | 271/97 |
| 2446917 | 4/1975 | Fed. Rep. of Germany | 271/98 |

*Primary Examiner*—E. H. Eickholt
*Attorney, Agent, or Firm*—Benjamin J. Barish

[57] ABSTRACT

A method of separating and feeding sheets from a stack comprises the steps of bringing a pick-up head into engagement with an intermediate portion of the top sheet of the stack while leaving the opposite ends of the sheet free, applying an air stream from each of the opposite sides of the stack and directed inwardly to impinge against the stack and to cause the free ends of the top sheets of the stack to separate from the underlying sheets, and moving the pick-up head with the picked-up top sheet away from the stack.

9 Claims, 34 Drawing Figures

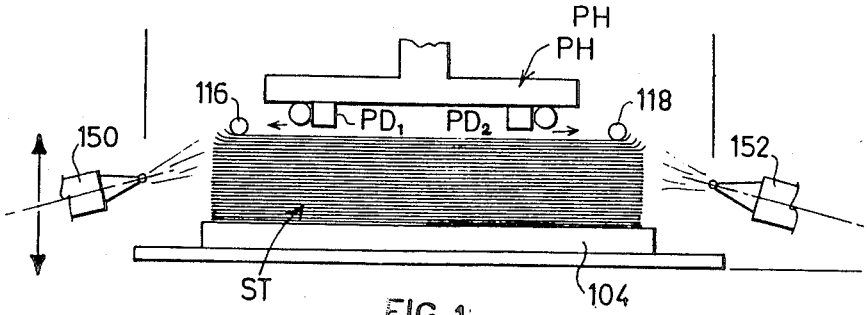
FIG. 1
FIG 2
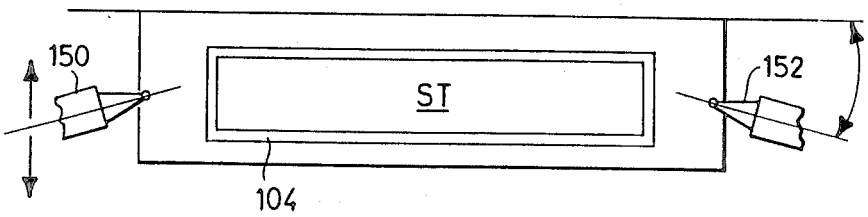
FIG. 5
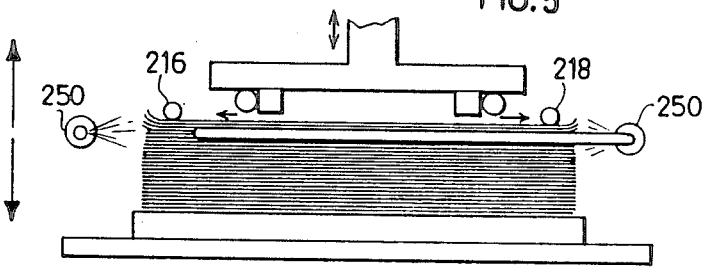
FIG 6
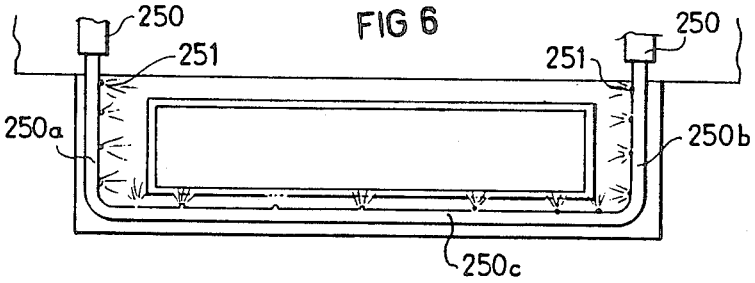

FIG. 13
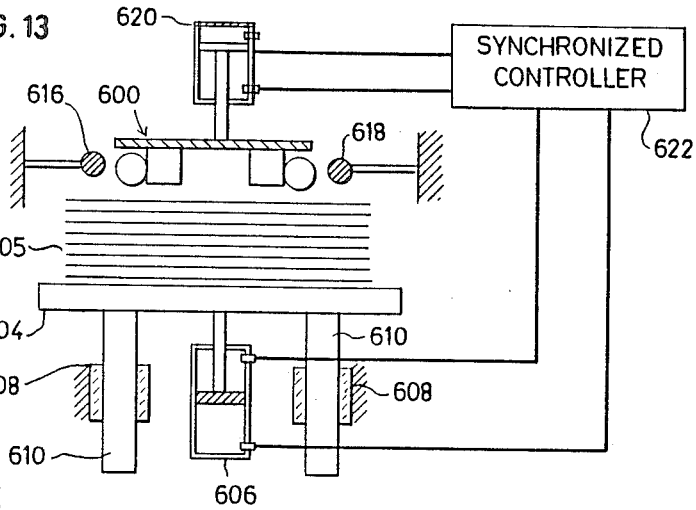
FIG. 15
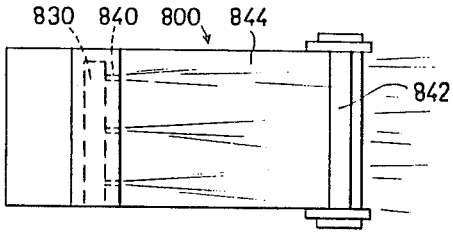
FIG 16 a
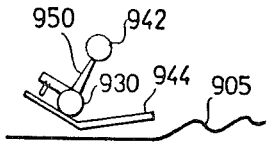
FIG 16
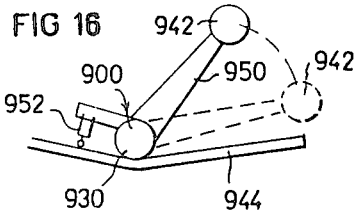
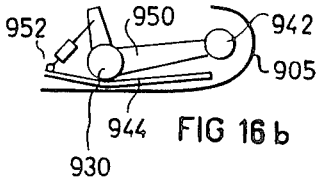
FIG 16 b
FIG. 15 a
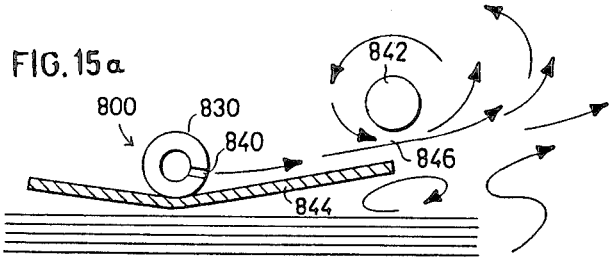

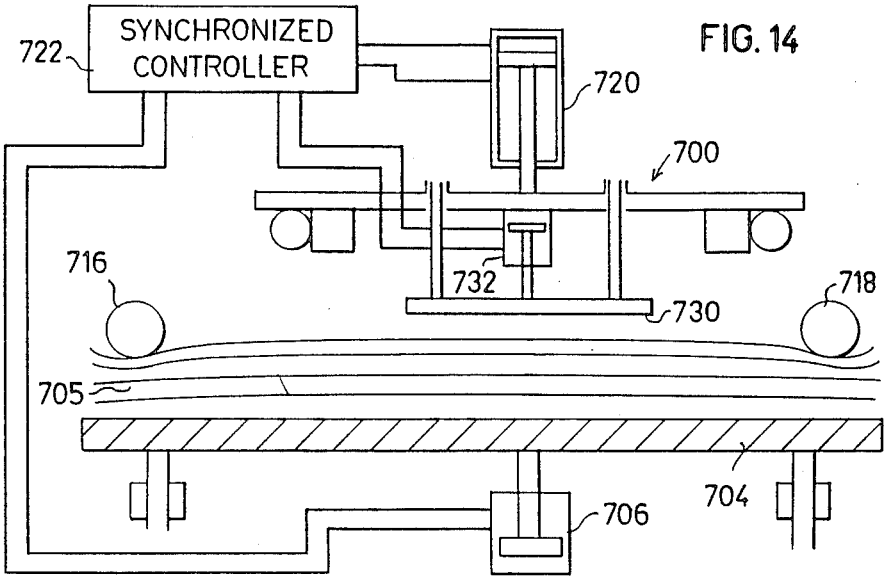
FIG. 14
FIG. 14 a
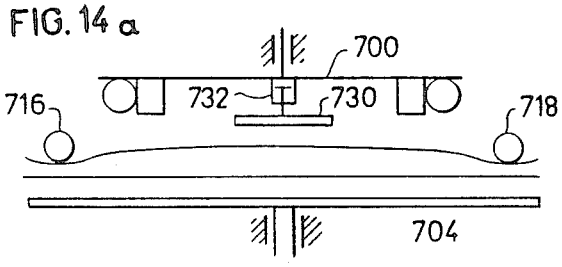
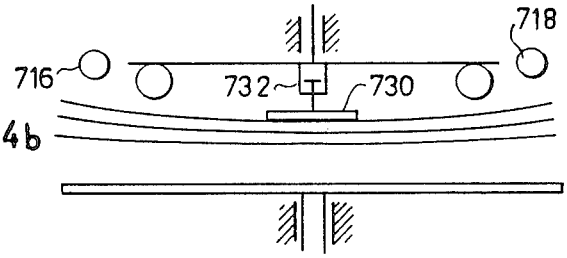
FIG. 14b
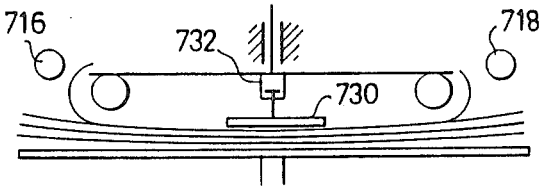
FIG. 14c

METHOD AND APPARATUS FOR SEPARATING, FEEDING AND/OR FOLDING SHEETS

RELATED APPLICATION

The application is related to U.S. patent application Ser. No. 06/678,585, filed Dec. 5, 1984, now U.S. Pat. No. 4,635,917, assigned to the same assignee as the present application.

BACKGROUND OF THE INVENTION

The present invention relates to methods and apparatus for separating, feeding and/or folding sheets. The invention is particularly useful for separating and feeding sheets of fabric from a stack or pile of fabric sheets according to the method and apparatus described in U.S. Pat. No. 4,635,917 now U.S. Pat. No. 4,635,917, assigned to the same assignee as the present application, and is therefore described below with respect to this application, but it will be appreciated that the invention could advantageously be used in other applications as well, such as for folding fabrics and other similar sheet material.

The above-cited U.S. Pat. No. 4,635,917 describes a method and apparatus for feeding sheets from a stack particularly useful with respect to fabrics or other limp or porous materials. Feeding such materials has heretofore presented considerable difficulty, as compared to the feeding of paper, cardboard, or similar sheets which is relatively simple. Briefly, the method and apparatus described in the above-cited patent application comprises an arrangement for: engaging the opposite edges of the upper sheet of the stack by a pair of restrainer members; bringing a pick-up head into engagement with the upper sheet of the stack while producing air streams from the pick-up head directed outwardly across the opposite edges of the upper sheet of the stack; lowering the pick-up head to depress the stack below the restrainer members whereby the air streams cause the opposite edges of the upper sheet of the stack to curl upwardly to clear the restrainer members; lifting the upper sheet from the stack; and permitting the stack to rise so as to bring the next sheet into engagement with the restrainer members, whereupon the stack is ready for feeding the next upper sheet.

Such an arrangement has been found to be far more effective than the previously known arrangements for feeding fabrics and other similar types of limp or porous materials. However, difficulties have been observed with respect to special types of fabrics having a multitude of free fibers or threads projecting from their faces, which fibers or threads tend to intermesh and become entangled with the fibers and threads of the adjoining layers, thereby making their separation extremely difficult and/or requiring extremely high air flow rates.

SUMMARY OF THE INVENTION

An object of the present invention is to provide a method of separating and feeding sheets from a stack having advantages in the above respects. Certain features of the present invention can also be used for folding a sheet, and therefore another object of the invention is to provide a method and apparatus for folding sheets.

According to a broad aspect of the present invention, there is provided a method of separating and feeding sheets from a stack, comprising the steps: bringing a pick-up head into engagement with an intermediate portion of the top sheet of the stack while leaving the opposite ends of said sheet free; applying an air stream from each of the opposite sides of the stack and directed inwardly to impinge against the stack and to cause the free ends of the top sheets of the stack to separate from the underlying sheets; and moving said pick-up head with said picked-up top sheet away from the stack.

As indicated earlier, the pick-up head is preferably of the type described in the above-cited patent application Ser. No. 06/678,585, and the method steps are also according to the sequence described in that patent application as briefly set forth above. When the method of the present invention is used with the technique of the above-cited patent application, it has been found that it enables the method to be used for separating and feeding sheets of fabric material which have a high tendency to becoming entangled between layers and which, heretofore, were usually fed manually because of the great difficulty in separating them. In addition, it has been found that the novel technique also substantially reduces the flow rate of the air streams required by the technique of the above-cited patent application particularly when feeding fabrics.

According to a further preferred feature of the present invention, the inwardly-directed air streams are produced also while the pick-up head is moved away from the stack to aid in completing the separation of the top sheet from the underlying sheet; this has been found to further reduce the difficulty and the air-flow rate required for separating fabric sheets particularly of the type having a high tendency of entangelement or intermeshing between their contacting faces.

The invention also provides sheet feeding apparatus in accordance with the foregoing method.

Further features and advantages of the invention will be apparent from the description below.

BRIEF DESCRIPTION OF THE DRAWINGS

The invention is herein described, by way of example only, with reference to the accompanying drawings, wherein:

FIG. 1 is an end elevational view illustrating one form of apparatus constructed in accordance with the present invention;

FIG. 2 is a top plan view illustrating the apparatus of FIG. 1 but with the pick-up head and the restrainer members removed;

FIG. 5 is an end elevational view illustrating another form of sheet separating and feeding device constructed in accordance with the present invention;

FIG. 6 is a top plan view of the apparatus of FIG. 5 with the pick-up head removed;

FIG. 13 schematically illustrates a further improvement;

FIG. 14 schematically illustrates a second improvement, FIGS. 14*a*, 14*b* and 14*c* showing the operation of the pick-up head when including this improvement;

FIGS. 15 and 15*a* are top and sectional views, respectively illustrating a still further improvement; and FIG. 16 illustrates a modification of the improvement of FIGS. 15 and 15*a*, FIGS. 16*a*, 16*b* being diagrams helpful in understanding the modification of FIG. 16.

DESCRIPTION OF PREFERRED EMBODIMENTS

The Embodiment of FIGS. 1–9

Figure 3:
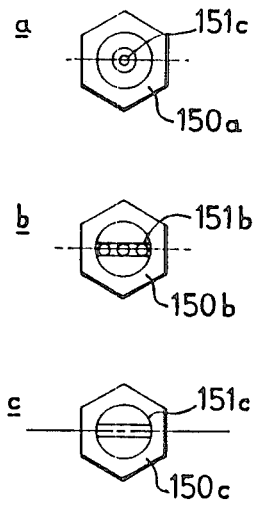
FIGS. 3*a–e* are end views illustrating different types of nozzles that may be used for producing the air streams, FIG. 3*f* being a top plan view of the nozzle of FIG. 3*e;*

The apparatus illustrated in FIGS. 1 and 2 of the drawings is particularly useful for separating and feeding sheets of fabric or similar materials having a high tendency of entanglement between sheets, form a stack or pile in accordance with the technique described in the above-cited U.S. Pat. No. 4,635,917. FIG. 1 illustrates these sheets in the form of a stack ST supported on a horizontal table 104, and a pick-up head PH overlying the table and movable toward it to engage an intermediate portion of the top sheet of the stack while leaving the opposite ends of the sheets free, and then away from the table to remove the top sheet of the stack. For this purpose, pick-up head PH includes a pick-up device PD1, PD2 at its opposite ends each of which produces air streams directed outwardly across the opposite edges of the top sheet. The apparatus illustrated in FIG. 1 further includes a pair of elongated, parallel restrainer rods 116, 118, located to overlie the opposite edges of the top sheet in each stack.

Insofar as described above, the apparatus illustrated in FIG. 1 operates as follows:

First, table 104 is driven upwardly so as to cause the opposite edges of the top sheet of the stack to be engaged by the two restraining rods 116, 118; pick-up head PH is then driven downwardly to bring its two pick-up device; PD1, PD2 into engagement with the upper sheet of each stack while pressurized air is applied to the pick-up devices to produce air streams tangentially to the lower cylindrical face of the pick-up device, the stack being thereby displaced downwardly to move it below the restraining rods 116, 118, while the air flow causes the opposite ends of the top sheet of each stack to curl upwardly to clear the restraining rods; and finally the pick-up head is moved upwardly, with the top sheet, away from the stack, thereby permitting the stack again to rise to bring the next underlying sheet into engagement with the restraining bars 116, 118. Further details in the construction and operation of such feeding apparatus are set forth in the above-cited U.S. Pat. No. 4,635,917.

In accordance with the present invention, the apparatus illustrated in FIGS. 1 and 2 further comprises one or more air nozzles 150, 152 located on the two opposite sides of the stack ST and directed inwardly towards each other so as to produce air streams impinging against the stack. This causes the free ends of the uppermost sheets, and particularly the top sheet, of the stack to rise and flutter, thereby aiding in the separation of the top sheet by the pick-up head PH. The air nozzles 150, 152 are operated to produce the air streams while the pick-up head PH depresses the stack below the restraining bars 116, 118 and applies its own air streams to curl the opposite ends of the top sheet upwardly to clear the restrainer bars, since the flutter produced by the air streams from nozzles 150, 152 greatly aid in the separation of the ends of the top sheet from the ends of the underlying sheet. Preferably, nozzles 150, 152 are also operated even before the pick-up head PH engages the top sheet in order to cause this flutter to start then; and the operation of these nozzles is preferably continued even after the pick-up head starts to move, with the top sheet away from the stack, such that the air streams produced by nozzles 150, 152 further aid in completing the separation of the top sheet from the underlying sheet during the movement of the top sheet away from the underlying sheet by the pick-up head.

It has been found that apparatus operating as described above can successfully separate fabric sheets having a very high tendency of entanglement between the fibers at their contacting faces as well as at their edges, something which, insofar as we are aware, has been successfully accomplished only by manual means. In addition, it has been found that providing the nozzles 150 and 152, and operating them as described above, also substantially reduces the required air flow rate for separating the fabric sheets, as compared to the air flow rate required without the air streams produced by nozzles 150, 152.

Nozzles 150, 152 may be oriented with respect to the ends of the stack ST at any desired angle about their horizontal axes, as shown in FIG. 1, or at any desired angle about their vertical axes, as shown in FIG. 2, depending upon the application and particularly the characteristics of the sheet materials to be separated.

Figure 4:
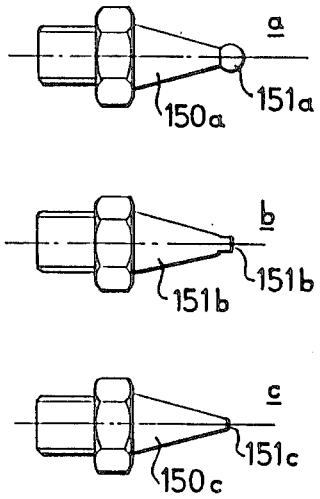
FIGS. 4*a–*4*e* are side elevational views illustrating the nozzles of FIGS. 3*a–e,* respectively.
Figure 4:
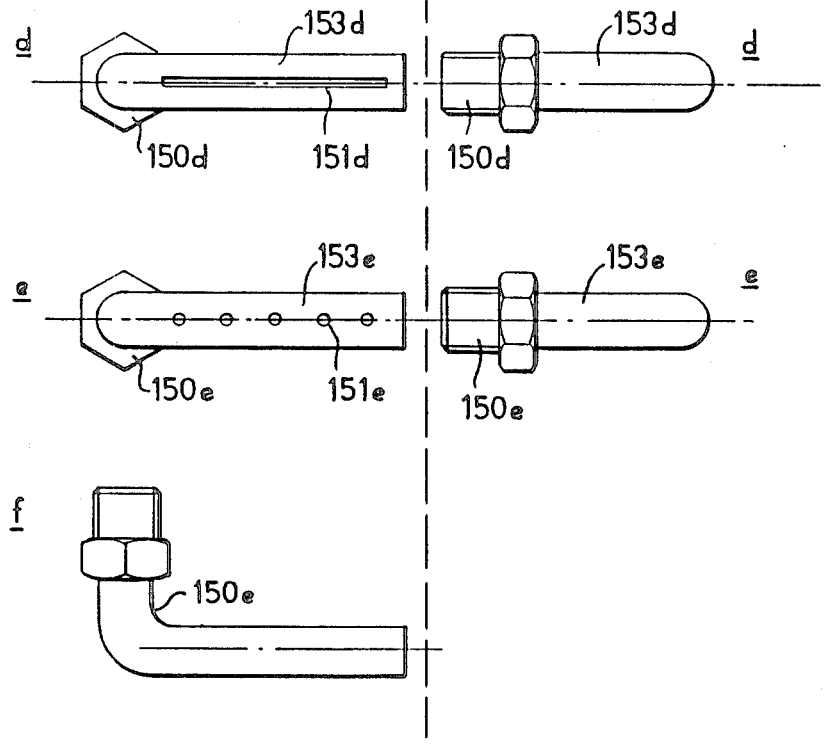

FIGS. 3 and 4 are end and side views, respectively, illustrating a number of different types of openings which may be used for nozzles 150, 152 of FIGS. 1 and 2. Thus, nozzle 150*a* includes a single circular opening 151*a* producing a single air stream of circular cross-section; nozzle 150*b* includes a plurality of circular openings 151*b* (in this case three openings in side-by-side relationship) producing a plurality of spaced air streams each of circular cross-section; nozzle 150*c* includes an opening 151*c* in the configuration of a short elongated slot for producing an air stream of rectangular cross section; nozzle 150*d* includes a tubular member 153*d* formed with an elongated slot 151*d* of substantial length, so as to produce a long air stream of rectangular cross-section; and nozzle 150*e* also includes a tubular member 153*e*, formed with a plurality of openings 151*e* so as to produce a plurality of air streams along a substantial length.

FIGS. 5 and 6 illustrate a still further arrangement, wherein the nozzles outwardly of the restraining bars 216, 218 are constituted of a single tube or header 250 which is bent to provide two end legs 250*a*, 250*b* parallel to the opposite ends of the stack, the end legs being joined by an intermediate leg 250*c* extending along the front of the stack. All the legs are provided with openings for producing air streams, which thus impinge against the stack along its two opposite ends and also along its front edge. The air nozzle arrangement illustrated in FIGS. 5 and 6 may also be operated as described above with respect to FIGS. 1 and 2, namely before the engagement of the pick-up head with the top sheet of the stack, after this engagement while the pick-up head depresses the top sheet of the stack below the restraining rods while the pick-up head applies its own air streams to curl the opposite ends of the top sheet outwardly to clear the restraining rods, and/or during the pick-off of the top sheet from the remainder of the stack.

Figure 7:
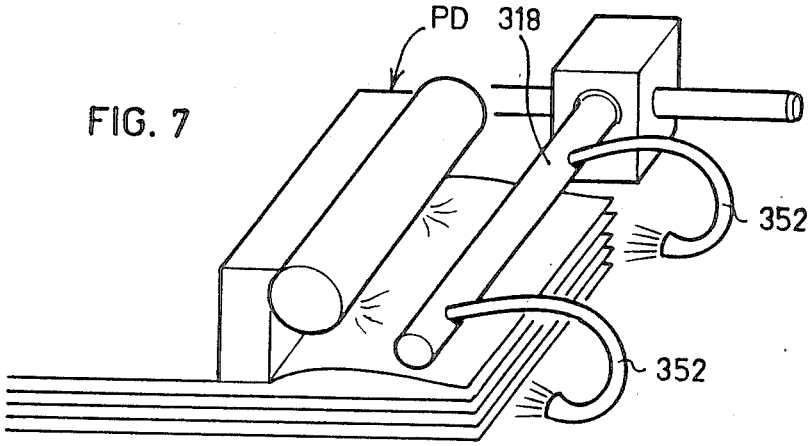
FIG. 7 is a three-dimensional view illustrating a still further form of sheet separating and feeding apparatus constructed in accordance with the present invention.

FIG. 7 illustrates a further arrangement, wherein the restraining rods (only rod 318 being shown) are also used for conducting the air streams to the nozzles, therein designated 352, which air nozzles are secured to their respective restraining rods. The nozzles 352 in the arrangement illustrated in FIG. 7 could also be operated as described above with respect to FIGS. 1 and 2 or FIGS. 5 and 6.

Figure 8:
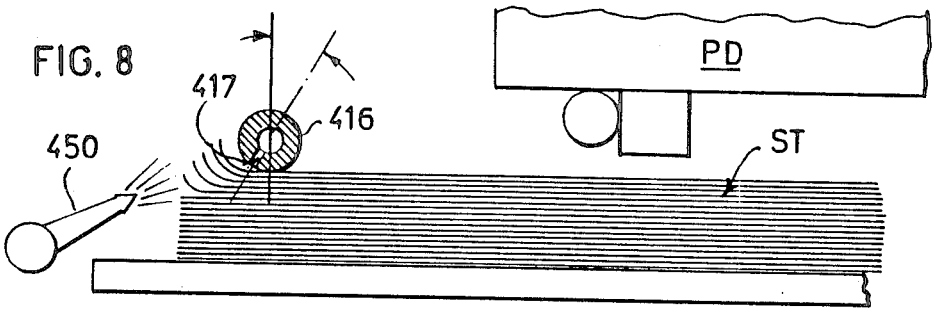
FIG. 8 is a side elevational view illustrating a still further form of sheet separating and feeding apparatus in accordance with the invention.
Figure 9:
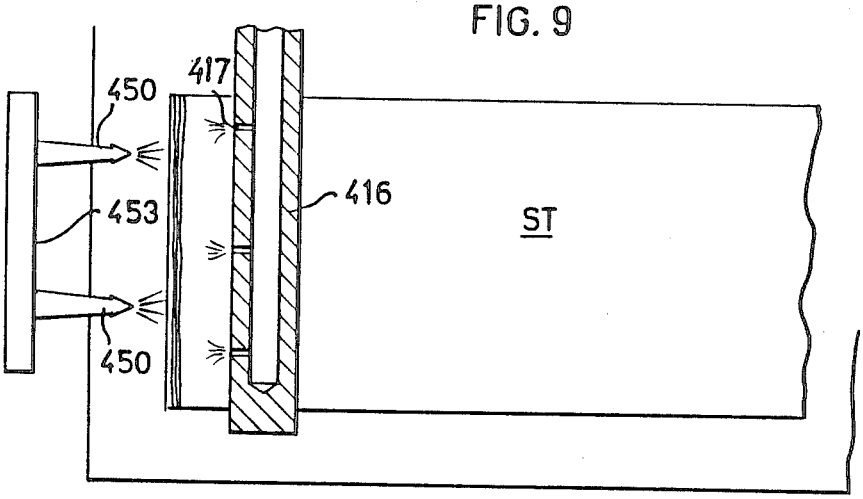
FIG. 9 is a top plan view of the apparatus of FIG. 8 but with the pick-up head removed.

FIGS. 8 and 9 illustrate a still further arrangement, wherein the retainer rods are also formed as air nozzles to produce air streams tending to curl the ends of the sheets of the stack. FIG. 8 illustrates only one retainer rod 416, this rod being formed of hollow, tubular construction and provided with a line of openings 417 along its length for outputting a plurality of air streams each having a component tangential to the top sheet of the stack. The curved surface of tubular member 416 facing the free end of the top sheet of the stack applies a force to that sheet tending to curl its free end according to the curvature of this curved surface. Tubular member 416 is adjustable about its horizontal axis, as shown by the arrow, in order to vary the angular position of its air output openings 417 with respect to the top sheet of the stack, and thereby to vary the tangential component of force applied to the free end of the stack tending to curl same about the outer face of this member.

The apparatus illustrated in FIGS. 8 and 9 includes a plurality of further nozzles 450 extending along the respective end of the stack and coupled together by a common header 453, for applying air streams to the respective end of the stack in the same manner as described above.

It will be appreciated that the opposite side of the stack also includes a tubular restrainer member corresponding to member 416, and a plurality of further air nozzles corresponding to air nozzles 450, both acting in the same manner but on the opposite end of the stack.

Figure 10:
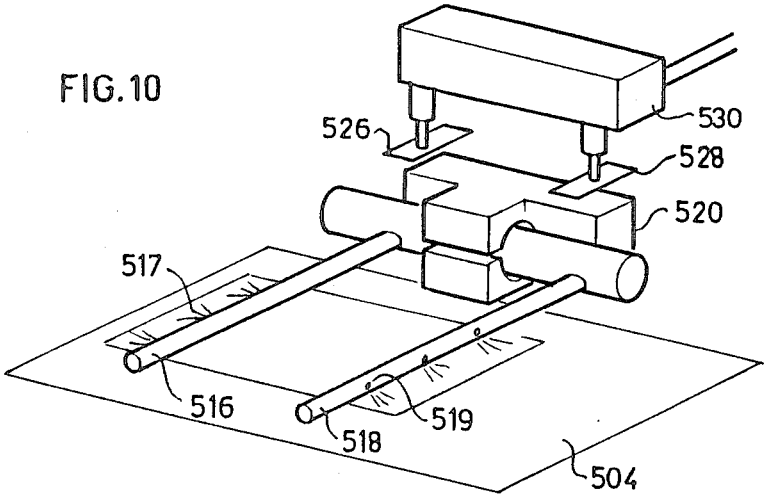
FIG. 10 is a three-dimensional view illustrating a further form of sheet feeding apparatus in accordance with the invention particularly useful for also folding the sheet.
Figure 11:
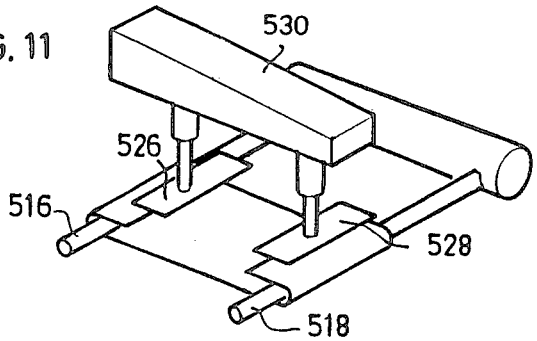
FIG. 11 is a three-dimensional view better illustrating the actual folding mechanism in the apparatus of FIG. 10.

The Embodiment of FIGS. 10–12

FIGS. 10 and 11 illustrate a further form of sheet feeding apparatus, which apparatus may also be used for folding the ends of the sheet. Thus, the apparatus illustrated in FIGS. 10 and 11 includes a horizontal table 504 for receiving a stack of sheets, or only one sheet, and a pair of tubular rods 516, 518 overlying the opposite ends of the sheet. Tubular members 516, 518 are of similar construction as tubular member 416 in FIGS. 8 and 9, and are formed with a plurality of air outlet openings 517, 519, respectively, directed towards the outer edges of the sheet so as to apply a tangential component of force thereto, causing the outer edges to curl upwardly to conform to the curvature of the tubular members as described above with respect to FIGS. 8 and 9. In this arrangement, the outer edges of the sheet are preferably curved more than 90° so as to overlie the intermediate portion of the sheet, as shown in FIGS. 11 and **12*b*. Tubular members 517, 519 are supported by a carriage 520 which can move these tubular members to their operative positions illustrated in FIGS. 10 and 11 (also in FIGS. 12*a*, 12*b*), or to a retracted position out of alignment with the sheet, this being schematically shown by the broken lines in FIG. 12*c***.

The apparatus illustrated in FIGS. 10 and 11 further includes presser means in the form of two depending pressure members 526, 528, overlying, and in alignment with, the two air stream producing members 516, 518.

The two pressure members 526, 528 are carried by a common carriage 530 which is also movable either to a retracted position illustrated in FIG. 10, or to an extended, operative position overlying the folded ends of the sheet as shown in FIG. 11.

Figure 12A:
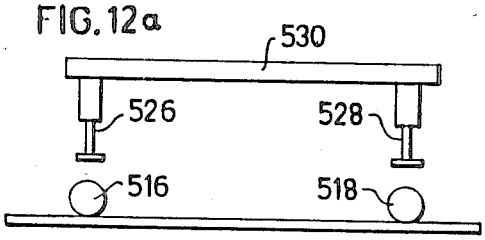
FIGS. 12*a*–12*d* are diagrammatical views illustrating the sequence of steps performed by the apparatus of FIGS. 10 and 11 during a folding operation.
Figure 12B:
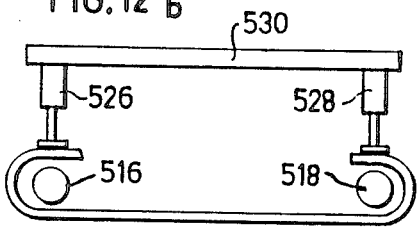
Figure 12C:
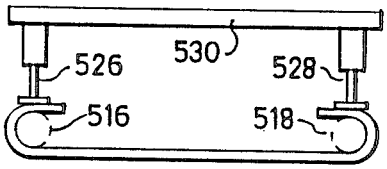
Figure 12D:
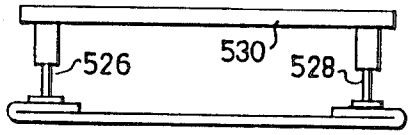

FIGS. **12*a*–12*b* illustrate the sequence of operations of the apparatus of FIGS. 10 and 11. Thus, as shown in FIG. 12*a*, the air stream producing members 516, 518 engage the sheet on the table and produce an air stream tending to curl the ends of the sheet around the outer face of members 516, 518 (FIG. 12*b*). Carriage 530 is then actuated to bring its pressure members 526, 528 downwardly against the curled ends of the sheet; at which time the air stream producing members 516, 518 are withdrawn (FIG. 12*c*), whereupon the pressure members 526, 528** are moved further downwardly to press the ends of the sheet against its intermediate portion to thereby produce a fold at each of its opposite ends.

The apparatus illustrated in FIGS. 10 and 11 may be used for folding the top sheet of a stack, and then removing and feeding it in the manner described earlier, or merely for folding the sheet, which sheet may then be removed in any other desired manner. Preferably, the apparatus illustrated in FIGS. 10 and 11 is also provided with the outboard nozzles, corresponding to nozzles 150, 152, to aid in curling the ends of the sheet around the tubular members 516, 518, and also to aid in removing the sheet from the stack as described above with respect to FIGS. 1 and 2 and the other illustrated arrangements.

The Embodiment of FIGS. 13–16*b*

The apparatus illustrated in FIG. 13 includes a similar pick-up head, generally designated 600, as described in U.S. Pat. No. 4,635,917. The illustrated apparatus further includes a table 604 for supplying a stack 605 of the sheet materials to be fed by the apparatus, and a piston-cylinder drive 606 for raising and lowering table 604. The movements of the table are guided by sleeves 608 fixed to the base (not shown) of the apparatus, receiving vertical posts 610 fixed to table 604. Overlying table 604 are a pair of restrainer members 616, 618 located to engage the opposite edges in the upper sheet of the stack.

In the arrangement illustrated in FIG. 13, the pick-up head 600 is driven towards and away from table 604 by a piston-cylinder drive 620. In addition, the operation of the table drive 606 is synchronized with the operation of the pick-up head drive 620 by a synchronized controller, schematically shown at 622, such that, when the pick-up head 600 is driven downwardly to engage the upper sheet of the stack 605, table 604 is also driven downwardly by its drive 106 to reduce or eliminate the compression of the upper sheet caused by the engagement thereof by the pick-up head. In other words, the downward movement of the pick-up head is accompanied by a downward movement of the table 604 so that there will be little, if any, compression of the upper sheet of the stack 605 at the time of engagement thereof by the pick-up head 600. It has been found that such an arrangement, by reducing or eliminating compression of the upper sheet of the stack when contacted by the pick-up head, considerably increases the reliability of the pick-up operation particularly when handling fabrics which have a high tendency of becoming entangled with each other.

A preferred manner of operation would be to have the synchronized controller 622, at the time drive 620 is actuated to lower the pick-up head 600, also to actuate drive 606 to lower table 604, but at a lower speed, so that the pick-up head 600 will catch up and make contact with the upper sheet of the stack 605 at the lower ends of the head and table strokes when there is very little, if any, relative motion between the two at the instant of contact; similarly, when drive 620 is actuated to raise pick-up head 600, drive 606 would also be actuated to raise the table 604 but at a lower speed to permit the pick-up head to reach its higher level above the table. Thus, the pick-up head 600 and table 604 would operate at different speeds, the compression effected by the pick-up head 600 with respect to the stack 605 being determined by the differential speed at the time of contact of the head with the upper sheet of the stack. As indicated above, such an arrangement has been found to reduce the internal stresses in the fabric sheets, and thereby, to reduce their tendency to adhere to each other.

The apparatus illustrated in FIG. 14 is similar to that of FIG. 13, in that it includes a pick-up head, generally designated 700, movable with respect to a table 704 adapted to contain a stack of sheets 705 underlying a pair of restrainer members 716, 718, the table and pick-up head including drives 706 and 720, respectively, and a synchronized controller 722 for controlling their operations.

FIG. 14, however, further includes a pressure plate, generally designated 730, carried by pick-up head 700 centrally thereof, and a drive 732 for the pressure plate. The operation of the pressure plate drive 732 is also controlled by controller 722, so as to produce the sequence of operations illustrated in FIGS. 14*a*, 14*b* and 14*c*.

Thus, as shown in FIG. 14*a*, as the pick-up head 700 approaches the upper sheet of the stack on table 704, pressure plate 730 is in its upper retracted position, above the lower faces of the pick-up head 700. After the pick-up head 700 has come into contact with the upper sheet of the stack, drive 732 of pressure plate 730 is actuated to move the pressure plate downwardly until it reaches (FIG. 14*b*) and passes (FIG. 14*c*) the level of the lower face of the pick-up head 700 to thereby compress the center of the stack. At this time, the side edges of the stack are also below the restrainer members 716, 718, and therefore the opposite edges of the upper sheet of the stack are free to curl upwardly, under the influence of the air streams produced by the pick-up head 700, to clear the restrainer members.

Since the pressure plate 730 at this instant has displaced the center of the stack further downwardly than the side edges, it has been found that this arrangement better permits the opposite edges of the upper sheet to curl upwardly to clear the restrainer members 716, 718 before the machine operation continues, wherein relative displacement between the stack and the restrainer members is effected in the opposite direction.

FIG. 15 illustrates a modification in the construction of each of the two pick-up devices included in the pick-up head. FIGS. 15 and 15*a* illustrate the pick-up device, generally designated 800, acting on the right side of the upper sheet of the stack, wherein it will be seen that the pick-up device includes a nozzle 830 formed with a plurality of air outlet openings 840, corresponding to housing 30 and air outlet openings 40 in the apparatus of U.S. Pat. No. 4,635,917. Each pick-up device further includes a rod of cylindrical cross-section 842, providing a curved surface curving outwardly away from the table, acting similarly as rod 42 in FIG. 4 of patent application Ser. No. 678,585, now U.S. Pat. No. 4,635,917, but of smaller diameter than that rod.

In the arrangement illustrated in FIGS. 15 and 15*a*, each pick-up device further includes a shield 844 extending between the air openings 840 in nozzle 830 and rod 842, the outer end of the shield being slightly spaced from rod 842 to provide a flow path for the air streams issuing from nozzle 830. Shield 844 guides the airflow so as to be tangential to the outer face of rod 842, in order to produce the forces tending to curl upwardly, around the rod, the outer edges of the upper sheet of the stack; this shield also acts to prevent the upper sheet of the stack from blocking the air openings 840 in nozzle 830. The arrangement illustrated in FIGS. 15 and 15*a*, therefore, increases the reliability of the apparatus and prevents a sheet from interfering with or blocking the airflows from the pick-up device tending to curl the edges of the upper sheet of the stack to clear the restrainer members (e.g. 616, 618 in FIG. 13 and 716, 718 in FIG. 14).

FIG. 16 illustrates a further modification that may be included in the pick-up device of FIGS. 15 and 15*a* in order to further increase its reliability particularly when feeding fabrics having a high tendency of entanglement between sheets. Thus, the pick-up device in FIG., 16, generally designated 900, also includes a nozzle 930, a cylindrical rod 942, and a shield 944. In FIG. 16, however, rod 942 is carried at the end of a lever 950 which is movable by a piston-cylinder drive 952 so as to move rod 942 either to an initial, inoperative position, as shown by full lines in FIG. 16, or to an operative position as shown by broken lines in FIG. 16.

In the inoperative position of rod 942, the rod has no significant influence on the air streams from nozzle 930, so that such air streams produce a fluttering action on the upper sheet of the stack as shown in FIG. 16*a*. This is the position of rod 942 when the pick-up head is distant from the upper sheet of the stack, the increased fluttering action thereby better separating the edges of the upper sheet from the underlying sheet, as shown in FIG. 16*a*.

However, as or after the pick-up head engages the upper sheet of the stack and displaces the complete stack below the restraining members (e.g. 616, 618, FIG. 13), drive 952 is actuated to move rod 942 to its operative position, as illustrated in broken lines in FIG. 16 and in full lines in FIG. 16*b*, whereby its presence in the air stream increases the forces tending to curl the outer edges of the upper sheet of the stack around the rod and thereby to clear the restrainer members.

While the invention has been described with respect to a number of preferred embodiments, it will be appreciated that these are shown for purposes of example only, and that many other variations, modifications and applications may be made.

What is claimed is:

1. A method of sseparating and feeding sheets from a stack comprising the steps:

bringing a pick-up head into engagement with an intermediate portion of the top sheet of the stack;

bringing a pair of tubular restrainer rods against the opposite ends of the top sheet of the stack outwardly from the pick-up head but spaced inwardly of the outer edges of the top sheet;

applying an air stream through each of said restrainer rods and outwardly thereof through spaced points along their lengths to curl the ends of the top sheet of the stack;

applying an additional air stream from each of the opposite sides of the stack and directed inwardly to impinge against the stack and to aid in the separation of the free ends of said top sheet of the stack from the underlying sheets; and moving said pick-up head with said pick-up top sheet away from the stack.

2. The method according to claim 1, wherein said air streams are produced also while the pick-up head is moved away from the stack to aid in completing the separation of said top sheet from the underlying sheet.

3. The method according to claim 1, wherein said additional air streams are applied from a plurality of points on each of the opposite sides of the stack.

4. Sheet feeding apparatus comprising:

a horizontal table for supporting a plurality of sheets in a stack;

a pick-up head overlying said table and having means for picking up the top sheet of the stack; and means for moving said pick-up head towards said table to engage an intermediate portion of the top sheet of a stack while leaving the opposite ends of said sheet free, and then away from said table to remove said top sheet from the stack;

a pair of tubular restrainer rods located on opposite sides of the stack outwardly of said pick-up head so as to be engageable with the top sheet of the stack along lines spaced slightly inwardly of its outer edges;

said tubular restrainer rods being formed with openings along their lengths facing the outer edges of the top sheet of the stack;

a source of pressurized air connected to said tubular restrainer rods to produce air streams outwardly thereof to curl the ends of the top sheet of the stack; and air nozzles located on opposite sides of the stack directed inwardly towards each other and connected to said source of pressurized air so as to produce air streams impingng against said stack to cause the free ends of the top sheet to flutter with respect to the underlying sheet of the stack, thereby aiding in the curling of the top sheet of the stack by the air streams produced by said tubular restrainer rods.

5. Apparatus according to claim 4, wherein said air nozzles are operated to produce air streams also while the pick-up head is moved away from the stack to complete the separation of said top sheet from the underlying sheet of the stack.

6. Apparatus according to claim 4, wherein each of said nozzles includes a single circular opening producing a single air stream of circular cross-section.

7. Apparatus according to claim 4, wherein each of said nozzles includes a plurality of circular openings producing a plurality of spaced air streams each of circular cross-section.

8. Apparatus according to claim 4, wherein each of said nozzles includes an opening in the configuration of an elongated slot, thereby producing an air stream of elongated cross-section.

9. Apparatus according to claim 4, wherein said nozzles are carried by a header extending along the opposite sides and the front of the stack.

* * * * *